US005724639A

United States Patent [19]

Tamura et al.

[11] Patent Number: 5,724,639

[45] Date of Patent: Mar. 3, 1998

[54] FIXING DEVICE HAVING SURFACES WITH DIFFERENT THERMAL CHARACTERISTICS

[75] Inventors: Toshihiro Tamura; Toshiaki Kagawa, both of Sakurai; Shogo Yokota, Fujiidera, all of Japan

[73] Assignee: Sharp, Kabushiki Kaisha, Osaka, Japan

[21] Appl. No.: 767,625

[22] Filed: Dec. 17, 1996

[30] Foreign Application Priority Data

Dec. 18, 1995 [JP] Japan ..... 7-328866

[51] Int. Cl.[6] ..... G03G 15/20

[52] U.S. Cl. ..... 399/333; 219/216; 399/330

[58] Field of Search ..... 399/320, 328, 399/330, 333; 219/216, 469–471; 118/60; 432/60

[56] References Cited

U.S. PATENT DOCUMENTS 3,902,845 9/1975 Murphy ..... 432/60
5,153,411 10/1992 Ndebi ..... 219/216

FOREIGN PATENT DOCUMENTS 55-36996 9/1980 Japan .
1-304481 12/1989 Japan .

OTHER PUBLICATIONS

T. Watanabe, et al. Electrophotographic Institute, vol. 31, No. 2 pp. 156–163 (1992).

K. Akiyama, Resume prepared for the 40th Short Class of Electrophotographic Institute, pp. 31–38 (1995).

S. Kimura, et al. Journal of Electrophotographic Institute, vol. 30, No. 4 pp. 398–402 (1991).

*Primary Examiner*—S. Lee
*Attorney, Agent, or Firm*—David G. Conlin; George W. Neuner

[57] ABSTRACT

The inner surface of a fixing roller is divided into two areas in the lengthwise direction thereof. In one of the areas where the increase rate of the surface temperature of the fixing roller is small, and improper fixing to recording paper is likely to occur, black heat resistant coating is applied to the inner surface of the fixing roller to improve heat absorption. In addition, in the other area where the surface state of the inner surface of the fixing roller is non-uniform, and heat absorption is not stable, transparent heat resistant coating is applied to the inner surface of the fixing roller to stabilize the heat absorption. It is attempted in this manner to make uniform the temperature of the fixing roller in the lengthwise direction thereof and thus to make uniform the fixing in the whole paper-passing area.

11 Claims, 10 Drawing Sheets

FIXING DEVICE HAVING SURFACES WITH DIFFERENT THERMAL CHARACTERISTICS

FIELD OF THE INVENTION

The present invention relates to fixing devices incorporated in apparatuses using an electrophotographic method, such as, electrophotographic copying machines, electrophotographic facsimiles and electrophotographic printers.

BACKGROUND OF THE INVENTION

A conventional fixing device incorporated in apparatuses using an electrophotographic method, such as, electrophotographic copying machines, electrophotographic facsimiles and electrophotographic printers typically employs a roller method including a fixing roller and a pressure roller pressed to that fixing roller. The fixing device of the roller method works as follows: First, both the fixing roller and the pressure roller are heated, or only the fixing roller is heated. Then, recording paper having thereon an unfixed toner image is passed between the pair of rollers so that the toner is fixed.

In the fixing device of the aforementioned roller method, the fixing roller is made very thin and the pressure roller with a small heat capacity is used in order to shorten the warm-up time of the fixing device and to reduce the fixing device in size.

However, the pair of rollers need to be supported so as to rotate freely. Therefore, the fixing device has a complex structure, which raises the price of the device, increases the size of the device, and restrict the shortening of the warm-up time.

In order to solve these problems, Japanese Publication for Examined Patent Application No. 55-36996/1980 (Tokukoushou 55-36996) discloses a press pad method that uses an unrotatable press member instead of the pressure roller. The press pad method fixes an image by inserting recording paper between a fixing roller and the press member pressed to the fixing roller.

FIG. 10 shows a configuration example of such a fixing device employing the press pad method. A fixing roller 112 is so configured as to include a hollow roller 112*a* made of aluminum and a coating layer 112*b* disposed around the whole outer surface of the hollow roller 112*a*. The coating layer 112*b*, made of synthetic resin of good mold release, paper transport and heat resistance properties such as silicon rubber, has a large friction coefficient. The fixing roller 112 has a heater lamp 113 in the axial portion thereof.

In addition, a press member 111 is provided below the fixing roller 112. The surface of the press member 11 that faces the fixing roller 112, that is, the press surface, is composed of a coating layer 114 made of substance having a small friction coefficient such as polytetrafluoroethylene resin. The press member 111 is fixed on the upper surface of a pressure plate 116 supported by a shaft 117, and is pressed to the fixing roller 112 with a predetermined pressure by a pressure spring 118. Recording paper 101 having thereon the unfixed toner image 102 is transported between the fixing roller 112 and the press member 111 for fixing.

However, if a thin metal cylinder is used as the fixing roller in order to shorten the warm-up time of the fixing device employing the pressure roller method or the press pad method, the state (roughness, gloss) of the inner surface becomes non-uniform. Here occurs a problem that the overshoot, when the temperature rises, is not stable in the lengthwise direction of the fixing roller.

Moreover, if the heater lamp inserted in the axial portion of the fixing roller is to be reduced in size in the lengthwise direction thereof in order to further reduce the fixing device in size, here occurs a problem that the temperature decreases at an end portion of a paper-passing region, thereby resulting in worsening fixing (fixing strength) of the toner.

SUMMARY OF THE INVENTION

An object of the present invention is to offer a highly durable and reliable fixing device that is small in size and that has good fixing property.

In order to accomplish the object, the fixing device in accordance with the present invention is a fixing device for fixing a toner image by heating and pressuring recording paper transported between a fixing roller and a press member, and includes a first area and a second area on an inner surface of the fixing roller in a lengthwise direction of the fixing roller, wherein the surfaces of the first and second areas have different thermal characteristics from each other.

In a preferred embodiment of the present invention, the first area has a thermal characteristic of improving heat absorption, and the second area has a thermal characteristic of stabilizing heat absorption.

In the above fixing device, the inner surface of the fixing roller is divided into the two areas in the lengthwise direction. The areas has different thermal characteristics from each other. For example, in the first area where the fixing roller has a low surface temperature, it is possible to attempt to improve the surface temperature by providing the thermal characteristic of improving the heat absorption. Besides, in the second area where non-uniformity of the surface state of the inner surface of the fixing roller causes non-uniformity of temperature rise, it is possible to suppress non-uniformity of temperature rise by providing the thermal characteristic of stabilizing the heat absorption.

Therefore, it is possible to quickly and stably raise the temperature of the fixing roller to a predetermined fixing temperature. Moreover, since it is possible to enhance fixing strength at an end portion of the fixing roller that is not obtainable by changing illumination distribution of a heater lamp, it is possible to offer a fixing device that is small in size and that has good fixing property.

In another preferred embodiment of the present invention, the thermal characteristic of the first area is obtained by applying colored heat resistant paint to the surface thereof, the thermal characteristic of the second area is obtained by applying transparent or white heat resistant paint to the surface thereof. In addition, the applied heat resistant paint has a thickness of not less than 5 μm.

In the above fixing device, the first area can improve the heat absorption by applying colored heat resistant paint to the surface thereof. Besides, the second area can stabilize the heat absorption by applying transparent or white heat resistant paint to the surface thereof. Therefore, it is possible to quickly, stably and uniformly raise the temperature of the fixing roller to a predetermined fixing temperature. Moreover, since it is possible to enhance fixing strength at an end portion of the fixing roller that is not obtainable by changing illumination distribution of a heater lamp, it is possible to offer a fixing device that is small in size and that has good fixing property.

In addition, it is possible to uniformly and stably raise the temperature of the fixing roller to the predetermined fixing temperature by setting the thickness of the applied heat resistant paint to not less than 5 μm.

For a fuller understanding of the nature and advantages of the invention, reference should be made to the ensuing detailed description taken in conjunction with the accompanying drawings.

BRIEF DESCRIPTION OF THE DRAWINGS

FIG. 5(*b*) is an explanatory drawing showing recording paper to which an image is fixed by a fixing device incorporating the heater lamp.

FIG. 8(*b*) is a graph showing temperature distribution of the fixing roller whose drive side of the inner surface is further treated with transparent heat resistant coating.

DESCRIPTION OF THE EMBODIMENTS

The following description, discussing an embodiment in accordance with the present invention, explains a fixing device of the present embodiment incorporated in a laser printer.

Figure 2:
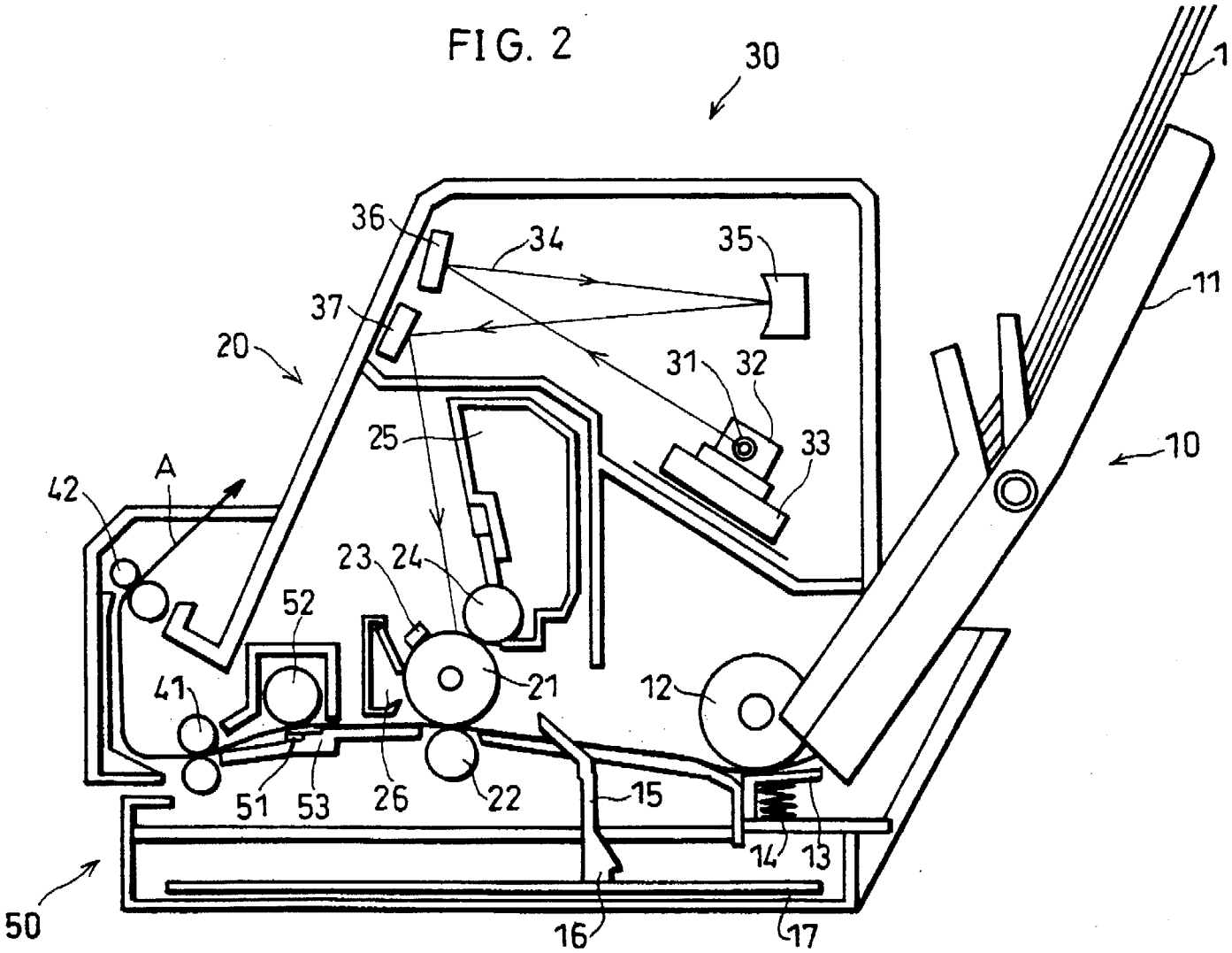
FIG. 2 is a configuration view schematically showing a configuration of a laser printer incorporating the fixing device.

The laser printer, as shown in FIG. 2, includes a paper feed section 10, an image forming device 20, a laser scanning section 30 and a fixing device 50 of the present embodiment. The paper feed section 10 transports a sheet of recording paper 1 to the image forming device 20 provided in the printer. The image forming device 20 transfers a toner image to the transported sheet of recording paper 1. The fixing device 50 fixes toner to the sheet of recording paper 1 sent from the image forming device 20. Thereafter, the sheet of recording paper 1 is ejected out of the printer by paper transport rollers 41 and 42. In short, the sheet of recording paper 1 moves along the path denoted by the arrow A of a thick line in FIG. 2.

The paper feed section 10 includes a paper feed tray 11, a paper feed roller 12, a paper-separating-use friction plate 13, a pressure spring 14, a paper-detection actuator 15, a paper-detection sensor 16 and a control circuit 17.

Upon reception of a print instruction, the sheets of recording paper 1 placed on the paper feed tray 11 are fed one by one into the printer by operation of the paper feed roller 12, the paper-separating-use friction plate 13 and the pressure spring 14. As the fed sheet of recording paper 1 pushes down the paper-detection actuator 15, the paper-detection sensor 16 outputs an electric signal instructing commencement of printing of the image. The control circuit 17 started by operation of the paper-detection actuator 15 transmits an image signal to a laser diode light-emitting unit 31 of the laser scanning section 30 so as to control ON/OFF of the light emitting diode.

The laser scanning section 30 includes the laser diode light-emitting unit 31, a scanning mirror 32, a scanning mirror motor 33 and reflection mirrors 35, 36 and 37.

The scanning mirror 32 is rotated at a constant high speed by the scanning mirror motor 33. In other words, laser light 34 scans in a vertical direction to the paper surface of FIG. 2. The laser light 34 radiated by the laser diode light-emitting unit 31 is reflected by the reflection mirrors 35, 36 and 37 so as to be applied to a photosensitive body 21 (to be described later in detail). When the laser light 34 is applied to the photosensitive body 21, the photosensitive body 21 is selectively exposed to the laser light 34 in accordance with ON/OFF information from the control circuit 17.

The image forming device 20 includes the photosensitive body 21, a transfer roller 22, a charging member 23, a developing roller 24, a developing unit 25 and a cleaning unit 26.

The surface charge of the photosensitive body 21 charged in advance by the charging member 23 is selectively discharged by the laser light 34. An electrostatic latent image is thus formed on the surface of the photosensitive body 21. The electrostatic latent image is visualized by the developing roller 24 and the developing unit 25. In other words, the toner supplied from the developing unit 25 is adhered to the electrostatic latent image on the photosensitive body 21 by the developing roller 24 so as to form the toner image.

Toner used for development is stored in the developing unit 25. The toner charged by being appropriately stirred in the developing unit 25 adheres to the above-mentioned electrostatic latent image by an interaction of the developing bias voltage applied to the developing roller 24 and an electric field generated by the surface potential of the photosensitive body 21, and thus can form a visual image on the photosensitive body 21.

Next, the sheet of recording paper 1 transported from the paper feed section 10 is transported downstream while being pinched by the photosensitive body 21 and the transfer roller 22. As the sheet of recording paper 1 is transported downstream, the toner image formed on the photosensitive body 21 is electrically absorbed and transferred to the sheet of recording paper 1 by an interaction of the electric field generated by a transfer voltage applied to the transfer roller 22. The toner that still remains on the photosensitive body 21 without having been transferred yet to the sheet of recording paper 1 is collected by the cleaning unit 26.

Thereafter, the sheet of recording paper 1 is transported to the fixing device 50. In the fixing device 50. An appropriate temperature and pressure are applied while the sheet of recording paper 1 is being pinched by a press pad 51 as a press member and a fixing roller 52 that is maintained at a constant temperature (155° C. in the present embodiment). The toner thereby melts and is fixed to the sheet of recording paper 1 to form a stable image. The sheet of recording paper 1 is transported and ejected out of the printer by the paper transport rollers 41 and 42.

Figure 3:
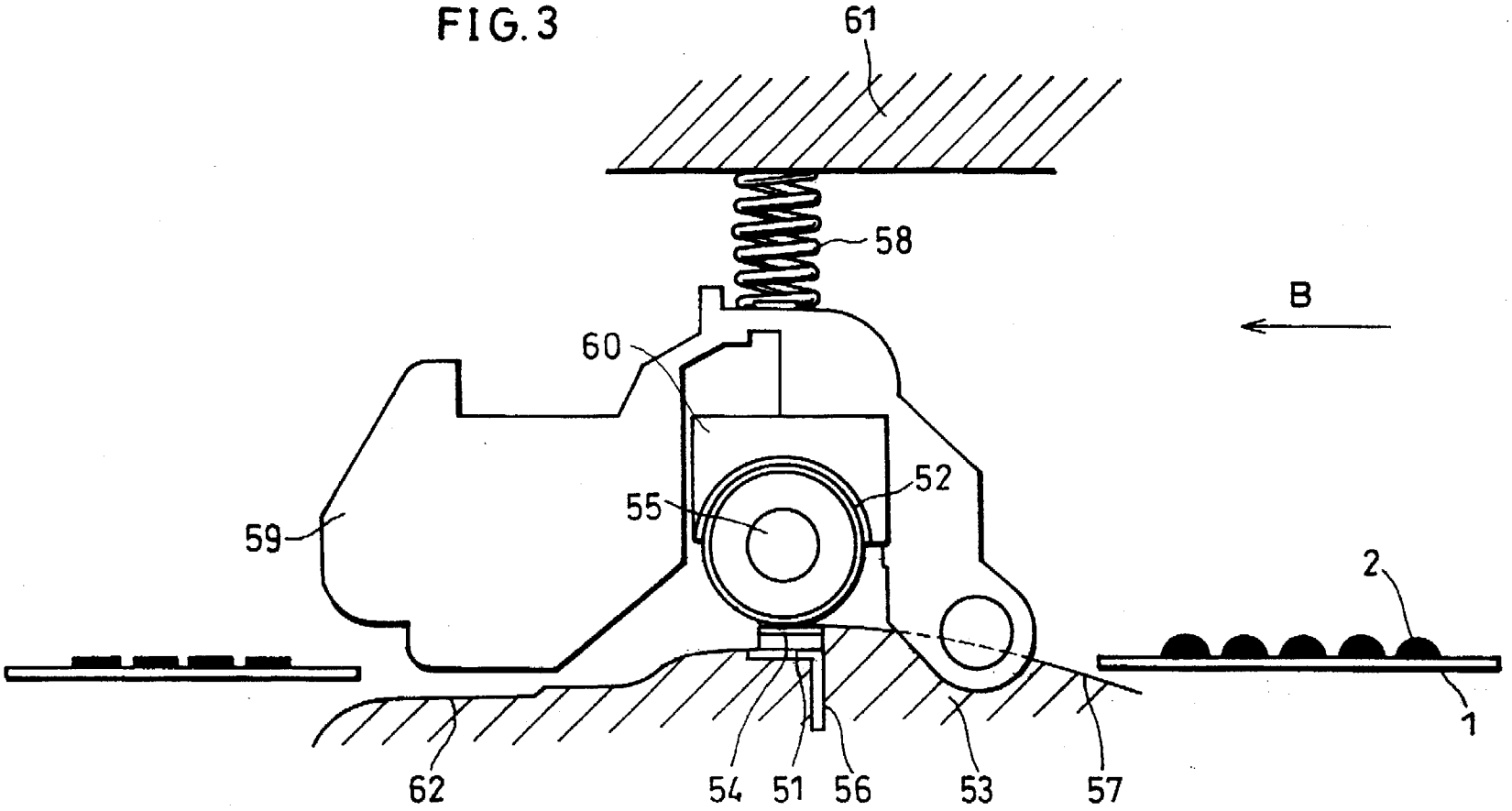
FIG. 3 is a configuration view schematically showing a configuration of the fixing device.

Next, the following will describe the fixing device 50 in detail. As shown in FIG. 3, the fixing device 50 has the press pad 51, the fixing roller 52 and a lower frame 53. The fixing roller 52 is composed of a cylinder (14 mm in outer diameter and 0.55 mm in thickness in the present embodiment) made of thin aluminum, whose whole outer surface is coated with synthetic resin material of good mold release, paper transport and heat resistance properties. An example for the synthetic resin material is fluororesin of a good mold release property and heat resistant rubber of a good paper transport property, such as fluororubber, that are mixed, applied and then baked.

Figure 1:
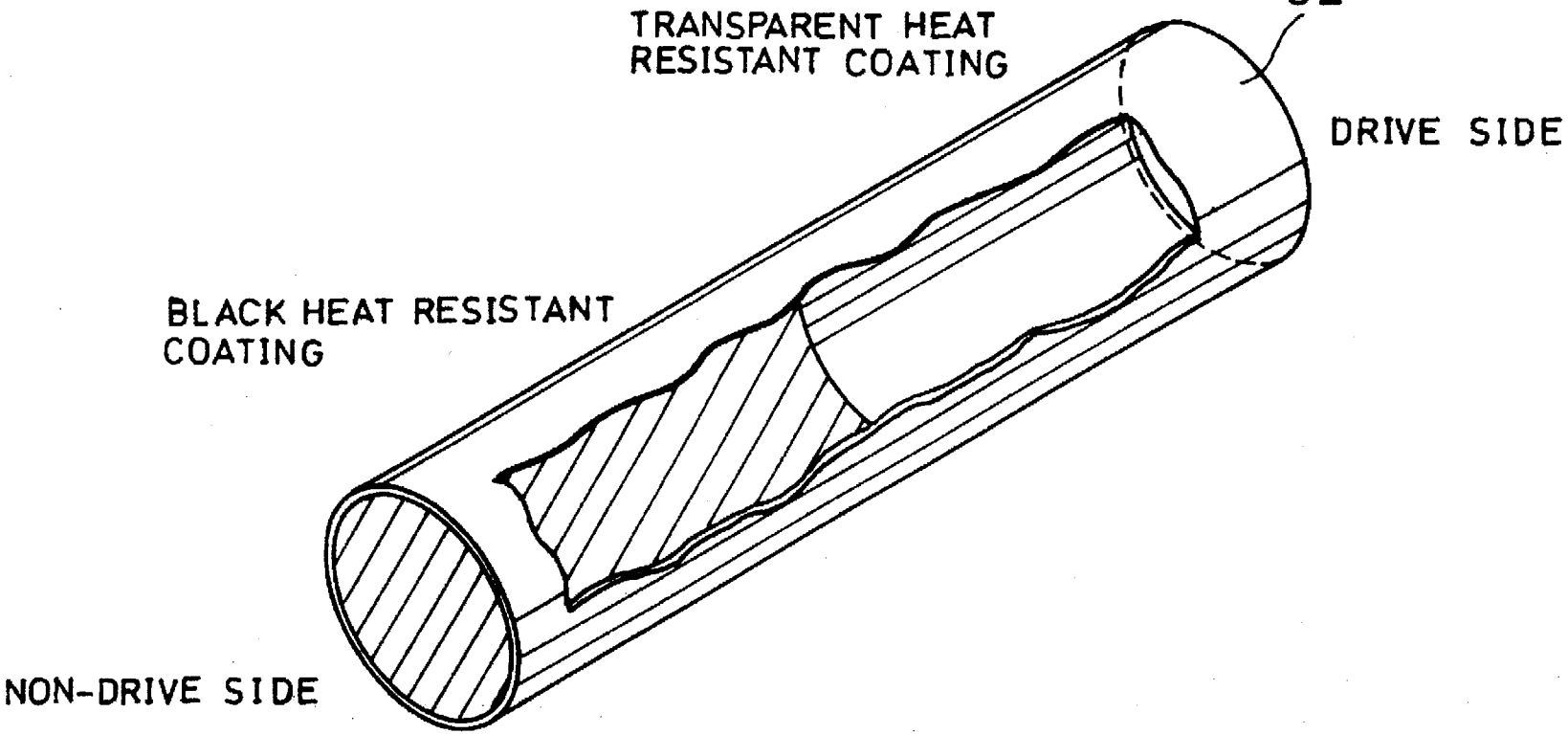
FIG. 1, illustrating an embodiment in accordance with the present invention, is a perspective view showing a fixing roller used in a fixing device.

In addition, as shown in FIG. 1, the inner surface of the fixing roller is divided into two in the lengthwise direction thereof. A region on the non-drive side (a first region) is treated with black heat resistant coating, and a region on the drive side (a second region) is treated with transparent heat resistant coating. A heater lamp 55 as radiating means (see FIG. 3) is inserted in the axial portion of the fixing roller 52.

Figure 4:
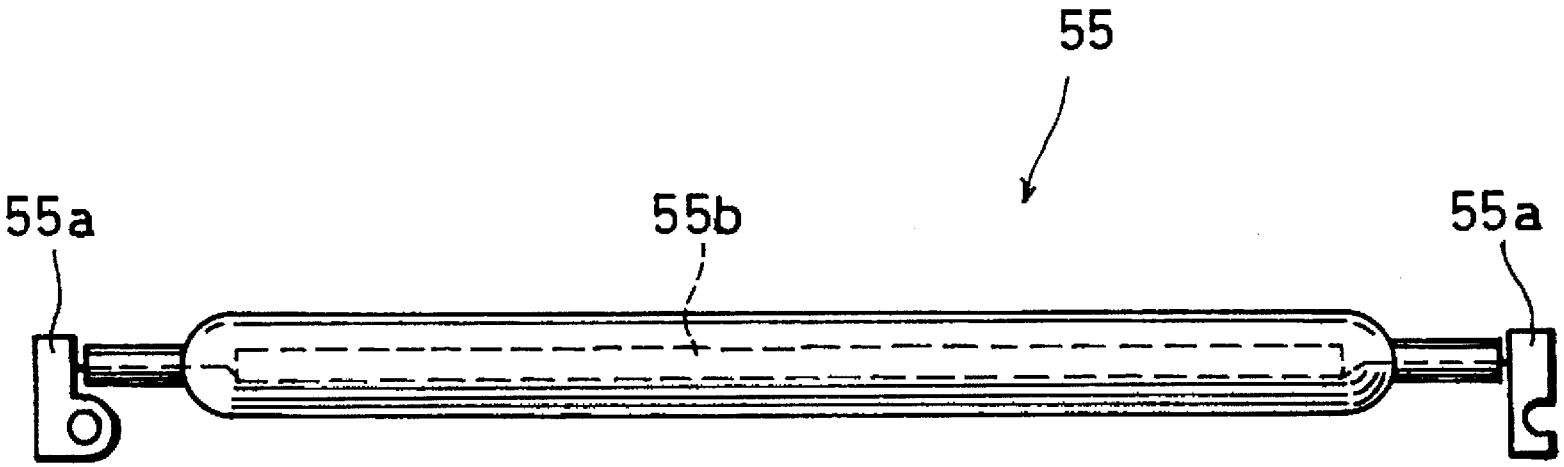
FIG. 4 is a configuration view schematically showing a configuration of a heater lamp incorporated in the fixing device.

FIG. 4 shows a configuration of the heater lamp 55 used for the fixing device 50. The heater lamp 55 has two SUS 304 electrodes 55*a* on the ends thereof. A coil portion 55*b* is heated by energizing the electrodes. The illumination distribution (heat distribution radiated at the fixing roller 52) of the heater lamp 55 in the lengthwise direction can be adjusted freely to some extent by changing the coil density of a light-emitting portion (coil length) of the heater lamp 55.

A semiarc bearing 60 (e.g., Esbear SS745 made by Star Light Industry Co., Ltd.) is disposed, as shown in FIG. 3, near each of the end portions of the fixing roller 52 vertically to the shaft of the fixing roller 52. The bearing 60 is coupled with a fixing cover 59 (e.g., Linite 945 made by E. I. du Pont de Nemours and Co.) composed of heat resistant resin. Above the fixing cover 59, a pressure spring 58 is inserted between the fixing cover 59 and an upper frame 61. The pressure spring 58 is thereby configured to press the fixing cover 59 with a constant applied pressure (2400 gf in the present embodiment).

The press pad 51 of the present embodiment is made of silicon sponge rubber (TL 4400 made by Ianock Co., Ltd.) of 2 mm in thickness. The Askar C hardness of the press pad 51 is about 30°. The press pad 51 is disposed between a curved metal plate 56 (SECC: thickness t=1.2 mm) and the outer surface of the fixing roller 52, and pressed by the operation of the pressure spring 58. The press pad 51 is fixed on the curved metal plate 56 with heat resistant double coated tape (ET tape made by Nissan Packing Co., Ltd.). Moreover, the press pad 51 is coupled with a boss sticking out from the lower frame 53 near the end portions of the curved metal plate 56, and thereby fixed to the lower frame 53.

A heat resistant sheet 54 is inserted between the press pad 51 and the fixing roller 52, and fixed to the lower frame 53 with heat resistant double coated tape. The heat resistant sheet 54 (300 μm in thickness) is composed of synthetic resin material of good mold release and heat resistant properties, such as, a mixture material of fluororesin and heat resistant filler. Examples of such fluororesin are polytetrafluoroethylene-perfluoro-alkylvinyleter copolymer resin (PFA) and polytetrafluoroethylene resin (PTFE). Examples of such heat resistant filler are carbon, molybdenum, graphite, boron nitride and polyimide. The heat resistant sheet 54 of the present invention is PTFE mixed with 5% polyimide filler.

The upstream side (the side on which the sheet of recording paper 1 is inserted) of the lower frame 53 with respect to the fixing roller 52 is configured to be higher than the downstream side by the thickness of the press pad 51 and the heat resistant sheet 54. The curved metal plate 56 is embedded in the boundary area where the height changes in this manner. The aforementioned upstream side is a prefixing guide 57 for guiding insertion of the sheet of recording paper 1, and the downstream side is a fixing guide 62 for guiding ejection of the sheet of recording paper 1 to which the image has been already fixed. Heat distribution and pressure distribution that are uniform in a lengthwise direction of the roller are essential to ensure enough fixing with the fixing device 50 configured as above.

The following description will discuss a fixing process by the fixing device 50 of the present embodiment. In the fixing device 50 configured as above, the sheet of recording paper 1, to which the toner image has been transferred but not yet fixed, moves along the paper-passing direction (the direction denoted by the arrow B in FIG. 3), is guided by the prefixing guide 57 to a nip portion between the fixing roller 52 and the heat resistant sheet 54, and passes the nip portion. When the sheet of recording paper 1 passes the nip portion, the unfixed toner image 2 that is electrostatically adhering to the sheet of recording paper 1 is fixed to the sheet of recording paper 1 by heat and pressure of the fixing roller 52. The predetermined characters and figures are formed in this manner. Thereafter, the sheet of recording paper 1 passes on the fixing guide 62 and is ejected.

Figure 5:
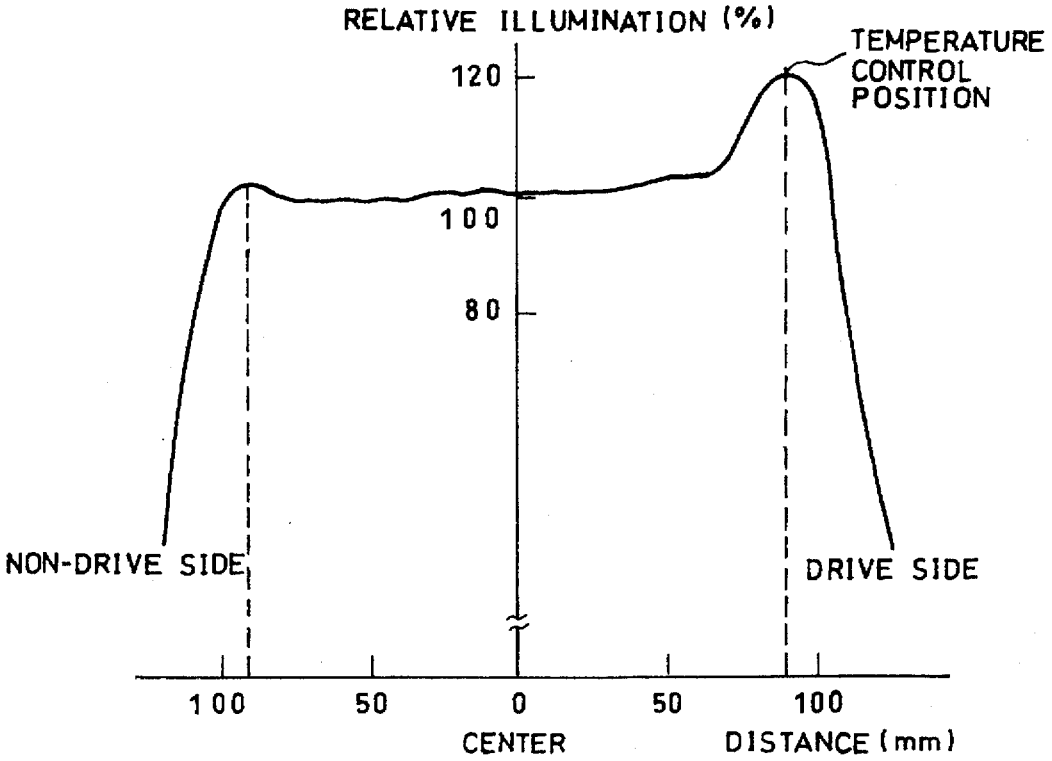
FIG. 5(*a*) is a graph showing illumination distribution of a typical heater lamp.
Figure 5:
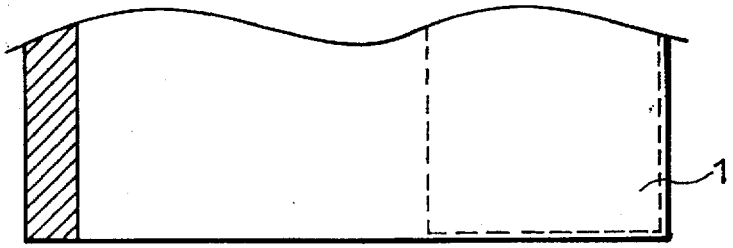
Figure 6:
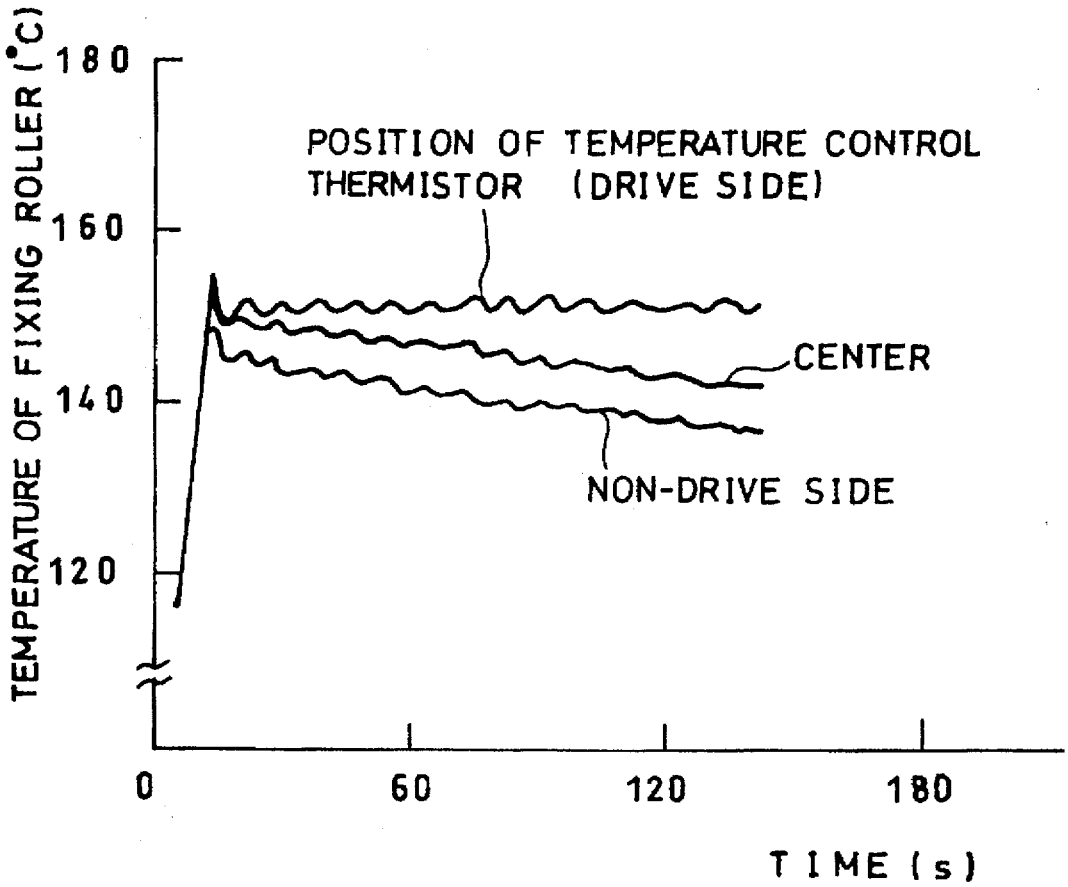
FIG. 6 is a graph showing temperature distribution of the fixing roller when the heater lamp having the illumination distribution in FIG. 5(*a*) is used.

Incidentally, FIG. 5(*a*) shows typical illumination distribution characteristics of the heater lamp 55. The axis of abscissa expresses the present position with the central position marked as 0. The axis of ordinate expresses relative illumination with the central position marked as 100%. The solid line in FIG. 5(*a*) represents recording paper of a letter size. The hatched area represents an improperly fixed area. The dashed line represents recording paper of an envelope size. FIG. 6 shows temperature distribution of a fixing roller incorporating the heater lamp 55, when a paper-passing experiment was conducted with the fixing device, using 128 g/m$^2$ paper of a letter size (216 mm in width). The fixing roller used for the experiment was of a conventional type, that received no surface treatment on the inner surface thereof.

In the present embodiment, the drive side refers to the side connected to a motor for rotating the fixing roller. The temperature control position refers to the position where a temperature control thermistor for maintaining the temperature of the fixing roller is disposed. The relative illumination is the highest at the temperature control position, since the thermistor at the temperature control position needs to be heated up to a predetermined temperature in a short period of time in order to shorten the warm-up time.

In recent efforts to reduce the size of the fixing device, the size of the heater lamp 55 has been reduced to 180 mm in the lengthwise direction thereof. However, when paper having a 216 mm width was passed with the heater lamp 55, the temperature decreased at the end portion of the paper expressed as the hatched area in FIG. 5(*b*), causing improper fixing.

As shown in FIG. 6, this is because the temperature distribution of the fixing roller of the fixing device incorporating the heater lamp 55 decreases with time, especially on the non-drive side (when a paper-passing experiment is conducted, using 128 g/m$^2$ paper of a letter size (216 mm in width)). As a result, as shown in FIG. 5(*b*), if the fixing to the sheet of recording paper 1 of a letter size is conducted with the fixing device, improper fixing occurs at the end portion on the non-drive side (shown as the hatched area in FIG. 5(*b*)). The dashed line in FIG. 5(*b*) represents the sheet of recording paper 1 of an envelope size.

Figure 7:
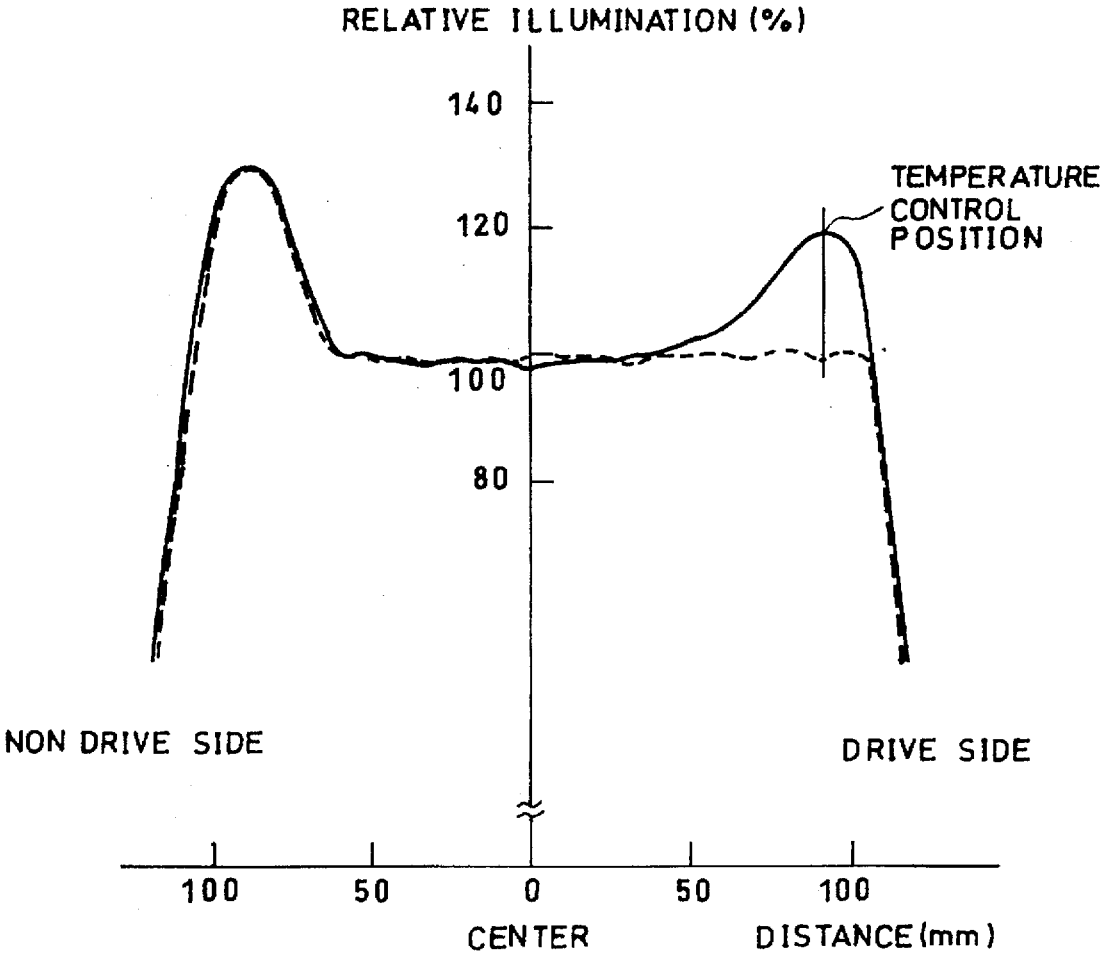
FIG. 7 is a graph showing illumination distribution to the fixing roller when a heater lamp, other than the one illustrated in FIG. 5(*a*), is used.

Besides, even when the relative illumination was increased near the end portions of the heater, as represented by the solid line in FIG. 7, in order to prevent a fall in temperature at the end portion of the paper, the improper fixing was not solved. Moreover, when the heater lamp 55 having illumination distribution according to which the relative illumination is smaller at the temperature control position as represented by the dashed line in FIG. 7 was used, the fixing produced good results at the end portions of the paper. However, when an envelope represented by the dashed line in FIG. 5(*b*) was continuously passed, there Occurred a problem that the temperature of the fixing roller became too high, especially, out of the envelope-passing area, and that the semiarc bearing provided on the non-drive side melted.

This is caused by reducing the relative illumination at the temperature control position, which lengthens the warm-up time of the heater lamp 55. In other words, as the warm-up time becomes longer, the temperature at the end portion on the non-drive side is raised to an enough high temperature where the improper fixing does not occur. However, there occurs a problem that when an envelope represented by the dashed line in FIG. 5(*b*) is continuously passed, the temperature of the fixing roller becomes too high, especially, out of the envelope-passing area.

Therefore, in the fixing device of the present embodiment, as shown in FIG. 1, on the non-drive side where the improper fixing occurs, black heat resistant coating (No. 600, black, made by Okitsumo Co., Ltd.) was applied to the inner surface of the fixing roller within 130 mm from the end of the fixing roller on the non-rive side. Then, a paper-passing experiment was conducted for case 1 where such a fixing roller was used with the heater lamp 55 having the illumination distribution shown in FIG. 5(*a*), for case 2 where a conventional fixing roller, with no black heat resistant coating applied thereon, was used with the heater lamp 55 having the illumination distribution shown in FIG. 5(*a*), and for case 3 where a conventional fixing roller was used with the heater lamp 55 having the illumination distribution represented by the solid line in FIG. 7. As a result, the fixing shown in Table 1 was obtained. Table 1 shows the results of the experiment.

TABLE 1

| Heater Lamp | Fixing | Evaluation |
|---|---|---|
| Case 2 | 42.6 | Poor |
| Case 3 | 65.3 | Normal |
| Case 1 | 82.5 | Good |

1) The fixing is evaluated by residual rate (%) of a rubbing test: Residual rate not lower than 80% is evaluated as good, not lower than 60% as normal, and lower than 60% as poor (concentration is 1.0, i.e., constant).

2) The percentage expressing the fixing is the average value obtained from 10 times of the experiment.

Moreover, a print experiment was conducted, using the above fixing device whose non-drive side of the fixing roller was treated with black heat resistant coating. The temperature distribution of the fixing roller, as shown in FIG. 8(*a*), at first, was higher than a predetermined temperature and decreased with time at both the center and the non-drive side.

Although the print experiment was conducted under the same conditions, the temperature distribution in the lengthwise direction of the fixing roller varied greatly except where the thermistor element for controlling the fixing roller temperature was disposed. The non-uniformity of the temperature distribution is caused by the following reasons. The surface state (roughness, gloss) of the inner surface of the fixing roller is non-uniform. The influence, etc. of the non-uniformity in reflectance caused by the non-uniform surface state results in difference in heat absorption, which in turn causes the non-uniform temperature distribution. If the pressure distribution applied to the Sheet of recording paper 1 by the fixing roller is equal at any position, the temperature and the fixing of the fixing roller are linear to each other in a certain range: it is a well-known fact that the fixing is poor when the temperature of the fixing roller is low, and that the fixing is good when the temperature of the fixing roller is high.

Transparent heat resistant coating (Xo-933 clear, made by Okitsumo Co., Ltd.) was applied to the part of the inner surface of the fixing roller 52 of the present embodiment where the black heat resistant coating was not applied, to eliminate the non-uniformity of the surface state of the inner surface of the fixing roller. In addition, FIG. 8(*b*) shows the temperature distribution of the fixing roller when such a fixing roller 52 was used.

Figure 8A:
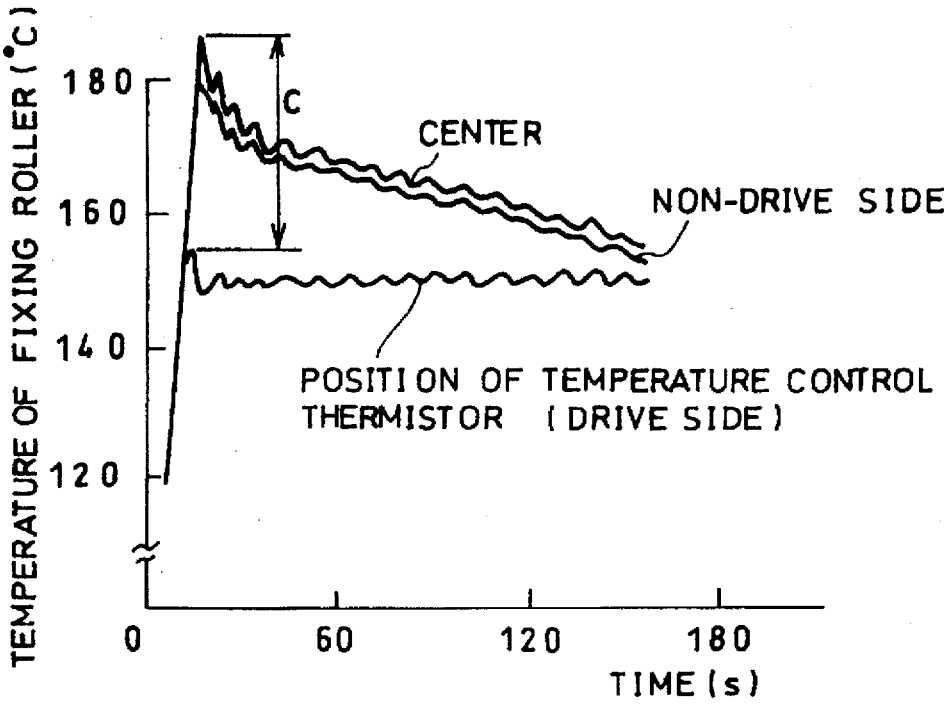
FIG. 8(*a*) is a graph showing temperature distribution of a fixing roller whose non-drive side of the inner surface is treated with black heat resistant coating.
Figure 8:
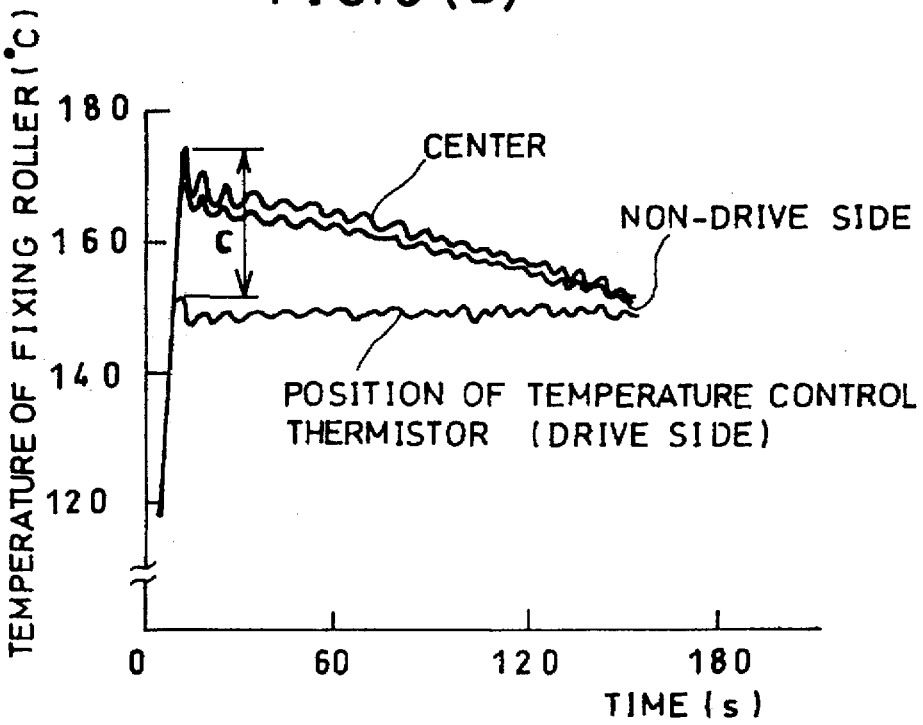

FIGS. 8(*a*) and 8(*b*) show different rises of the temperature of the fixing roller (hereinafter, will be referred to as overshoot; denoted as C in FIGS. 8(*a*) and 8(*b*)). This is temperature distribution caused by difference in the heat absorption of the inner surface of the fixing roller. The difference was found between manufacturing lots.

More specifically, as shown in FIG. 8(*a*), when the transparent heat resistant coating was not applied on the drive side of the fixing roller, since the heat absorption of the inner surface of the fixing roller differs greatly, the overshoot became large. Moreover, since the non-uniformity of the surface state was great on the drive side of the fixing roller even in the same manufacturing lot, the resulting overshoot was greatly non-uniform.

When the overshoot was large, there occurred a high-temperature offset where the toner was retransferred to the fixing roller, and therefore, there occurred a problem that when recording paper of a small size, such as, A5 paper, a postcard and an envelope, was continuously used for printing, the temperature of the fixing roller became high out of the paper-passing area.

Meanwhile, as shown in FIG. 8(*b*), when the transparent heat resistant coating was applied on the drive side of the fixing roller 52, since the heat absorption of the inner surface of the fixing roller 52 treated with the transparent heat resistant coating became stable, the overshoot became small. Moreover, the overshoot became stable, and good temperature distribution was obtained with no non-uniformity between manufacturing lots.

However, the above-mentioned effects of the heat resistant coating is influenced largely by the thickness of the heat resistant coating. The influence of the thickness of the heat resistant coating on the overshoot was studied. FIG. 2 shows the results.

TABLE 2

| Thickness of Heat Resistant Coating on Inner Surface (μm) | Amount of Overshoot at Central Portion (°C.) | Evaluation |
|---|---|---|
| 0 | 0 to 20 | Poor |
| 3 | 20 to 35 | Poor |
| 5 | 15 to 20 | Good |
| Thicker than 10 | 15 to 17 | Good |

1) The thicknesses in the Table 2 represent thicknesses of both kinds of the heat resistant coating.

2) The amount of overshoot was defined as the difference from the temperature at the temperature control position.

3) When no heat resistant coating was applied (i.e., when the thickness is 0 μm), the amount of overshoot is small. However, in some cases, the temperature is lower than the preferred temperature at the central portion and at the end portion on the non-drive side, and the amount of overshoot becomes greatly non-uniform. Therefore, the case is evaluated as poor.

These results show that heat resistant coating of a less than 5 μm thickness produces no substantial effects. Moreover, the appropriate maximum thickness of the heat resistant coating is between 50 μm and 100 μm.

In the present embodiment, the black heat resistant coating was applied on the non-drive side of the inner surface of the fixing roller 52, and the transparent heat resistant coating was applied on the drive side thereof. The two different kinds of surface treatment layers were provided for the following reasons. The surface treatment layer where the black heat resistant coating was applied was for maintaining heat quantity by improving the heat absorption when the fixing device was to be reduced in size. The surface treatment layer where the transparent heat resistant coating was applied was for stabilizing the heat absorption by eliminating the non-uniformity of the surface state of the inner surface of the fixing roller 52. Moreover, the application of the heat resistant coating and the resulting production of appropriate overshoot prevent an unnecessarily large quantity of heat from being applied to the fixing roller. Therefore, abrasion characteristics of the fluororesin, such as PTFE, that is applied on the roller surface are improved, and the resultant durability as a roller is improved.

Silver heat resistant coating may be applied instead of the black heat resistant coating to improve the heat absorption. White heat resistant coating may be applied instead of the transparent heat resistant coating to stabilize the heat absorption. These colors may be chosen in any combination according to the illumination distribution of the heater lamp 55. Moreover, instead of applying the transparent or white heat resistant coating, a uniform surface treatment, for example, a caustic treatment of cleaning with sodium hydroxide solution or a sand blast treatment, can produce the same results as above. Table 3 shows results of the amounts of the overshoot when such surface treatments were carried out.

TABLE 3

| Surface Treatment Layer of First Area | Surface Treatment Layer of Second Area | Amount of Overshoot at Central Portion |
|---|---|---|
| Black | Transparent | 15 to 17 |
| Black | White | 0 to 13 |
| Black | Caustic Treatment | 25 to 28 |
| Black | Blast | 20 to 22 |
| Silver | Caustic Treatment | 10 to 13 |

1) The thickness of the heat resistant coating is 10 μm.

Figure 9:
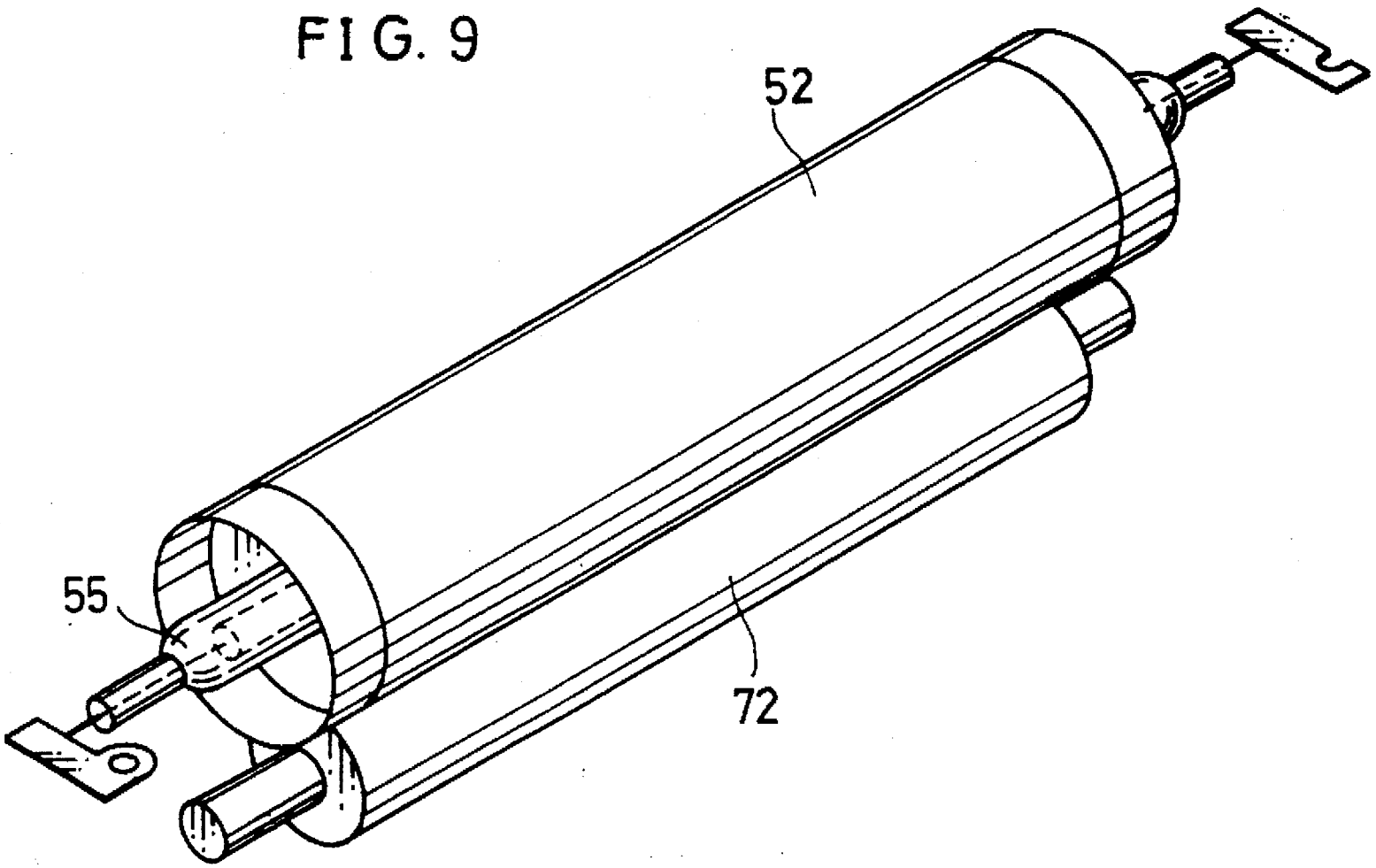
FIG. 9 is a configuration view schematically showing a configuration of a fixing device employing a pressure roller method.
Figure 10:
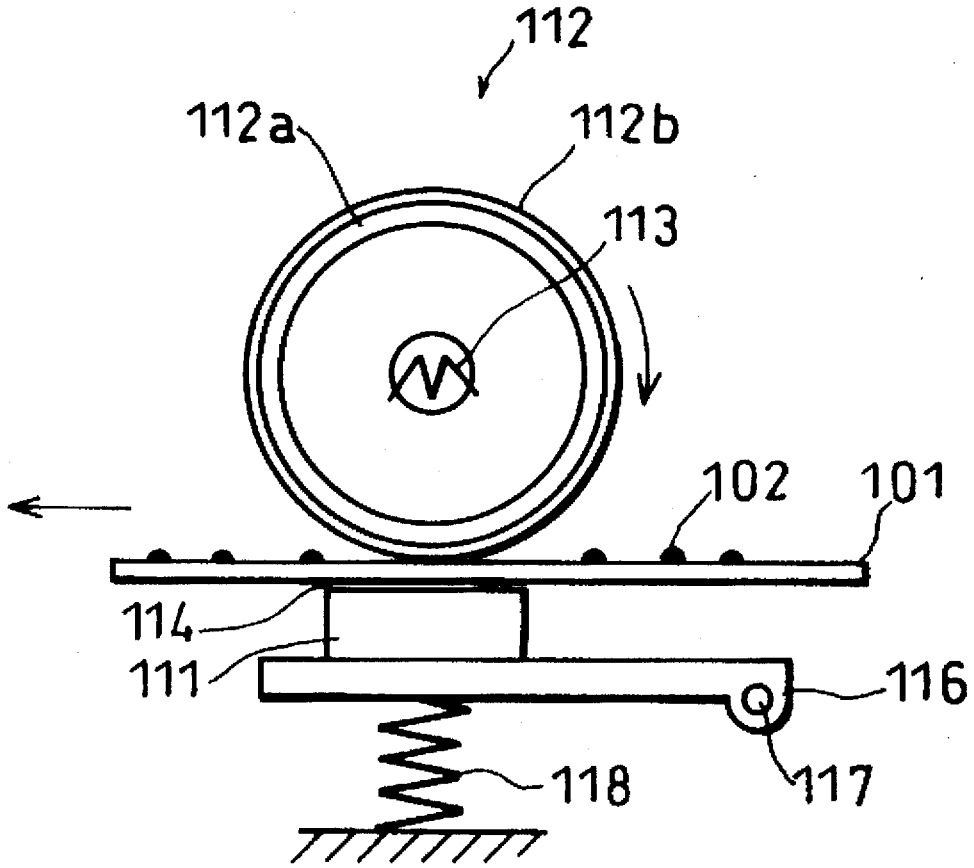
FIG. 10 is a configuration view schematically showing a configuration employing a pressure pad method.

Moreover, when the fixing roller of the present embodiment was used for a fixing mechanism of the pressure roller method as shown in FIG. 9, i.e., for the combination of the fixing roller 52 and the pressure roller 72 as a fixing member (silicon solid rubber), the same results were obtained.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing device for fixing a toner image by heating and pressuring recording paper transported between a fixing roller and a press member, the fixing device comprising:

a first area and a second area on an inner surface of the fixing roller in a lengthwise direction of the fixing roller, wherein the surfaces of the first and second areas have different thermal characteristics from each other.

2. The fixing device as defined in claim 1, wherein the first area has a thermal characteristic of improving heat absorption, and the second area has a characteristic of stabilizing heat absorption.

3. The fixing device as defined in claim 2, further comprising radiating means for heating the fixing roller, wherein the thermal characteristic of the first area and the thermal characteristic of the second area are obtained by applying heat resistant paint to the respective surfaces, and a combination of colors of the heat resistant paint is decided in accordance with illumination distribution of the radiating means.

4. The fixing device as defined in claim 2, wherein the thermal characteristic of the first area is obtained by applying colored heat resistant paint to the surface thereof, and the thermal characteristic of the second area is obtained by applying transparent or white heat resistant paint to the surface thereof.

5. The fixing device as defined in claim 4, wherein the colored heat resistant paint is selected from the group consisting of black and silver.

6. The fixing device as defined in claim 2, wherein the thermal characteristic of the first area is obtained by applying colored heat resistant paint to the surface thereof, and the thermal characteristic of the second area is obtained by applying a caustic treatment to the surface thereof.

7. The fixing device as defined in claim 2, wherein the thermal characteristic of the first area is obtained by applying colored heat resistant paint to the surface thereof, and the thermal characteristic of the second area is obtained by applying a sand blast treatment to the surface thereof.

8. The fixing device as defined in claim 3, wherein the applied heat resistant paint has a thickness between 5 μm and 100 μm.

9. The fixing device as defined in claim 4, wherein said applied heat resistant paint of the first area and said applied heat resistant paint of the second area each has a thickness between 5 μm and 100 μm.

10. The fixing device as defined in claim 5, wherein said applied heat resistant paint of the first area and said applied heat resistant paint of the second area each has a thickness between 5 μm and 100 μm.

11. The fixing device as defined in claim 1, wherein the fixing device is used in an apparatus employing an electrophotographic process.

* * * * *